United States Patent [19]

Minks

[11] Patent Number: 4,664,080

[45] Date of Patent: May 12, 1987

[54] SELECTIVE SPEED LIMITING APPARATUS FOR INTERNAL COMBUSTION ENGINE

[76] Inventor: Floyd M. Minks, 2700 Partin Settlement Rd., Kississimee, Fla. 32743

[21] Appl. No.: 791,765

[22] Filed: Oct. 28, 1985

[51] Int. Cl.[4] ..... F02P 5/14

[52] U.S. Cl. ..... 123/335; 123/198 DC; 180/272

[58] Field of Search ..... 123/335, 198 DC; 180/272

[56] References Cited

U.S. PATENT DOCUMENTS

| | | | |
|---|---|---|---|
| 4,074,665 | 2/1978 | Patis | 123/335 |
| 4,237,997 | 12/1980 | Swanson | 180/272 |
| 4,336,778 | 6/1982 | Howard | 123/335 |
| 4,404,940 | 9/1983 | Sieja | 123/335 |
| 4,491,105 | 1/1985 | Johansson | 123/335 |
| 4,553,517 | 11/1985 | Andreasson | 123/335 |

*Primary Examiner*—Ronald B. Cox

*Attorney, Agent, or Firm*—Duckworth, Allen, Dyer

[57] ABSTRACT

This disclosure relates to apparatus for selectively limiting the speed of an internal combustion engine by momentarily removing the ignition voltage to the spark plug of said engine at one or two preselected speeds below the maximum speed capability of the engine. Said speed limits are activated in response to electrical input signals generated by switches controlled by the operating condition of a vehicle driven by said engine. Such electrical signals could be determined by whether the vehicle transmission is in reverse and/or switches selectively operated by the operator. This emitter therefore controls the engine and thus vehicle speeds to increase the safety of the vehicle under selective operating conditions.

12 Claims, 2 Drawing Figures

SELECTIVE SPEED LIMITING APPARATUS FOR INTERNAL COMBUSTION ENGINE

This invention relates to an electronic govenor for interrupting the ignition to an internal combustion engine under certain selected combinations of operating conditions.

BACKGROUND OF THE INVENTION

All-terrain vehicles generally of small size have become very popular for recreational use as well as ther applications. The necessity of manuevarbility and light weight of these vehicles contributes to difficulty in safe control of the vehicles under some operating conditions such as when operated in reverse or by an inexperienced operator. Thus it is desireable to incorporate a device to govern the maximum speed of the vehicle under certain operating conditions. One method of doing this is through an electronic governor attached to the ignition of the engine, limiting the engine speed to a certain preselected level under the desired operating conditions. Furthermore, two different limit speeds or RPM's may be necessary if the vehicle includes an automatic transmission, whether of the torque converter type generally associated with an automobile or the centrifical clutch and variable ratio of pulley combination generally associated with vehicles such as snowmobiles. An example would be to limit the speed in reverse to a normal slow speed, however, having a further override to allow an engine speed somewhat higher but still below the maximum capability of the engine for use only in situations of backing up where the vehicle needs to proceed from where it is stuck or attached to a trailer or other load requiring higher engine output in reverse.

It is a object of this invention to accomplish these RPM limits using signals normally available from the ignition system and the alternator commonly used on vehicles of this type.

DESCRIPTION OF THE DRAWINGS

The above and other objects, features and advantages will become apparent from the following detailed description taken in conjunction with the accompanying drawing in which.

DETAILED DESCRIPTION OF PREFERRED EMBODIMENT

Figure 1:
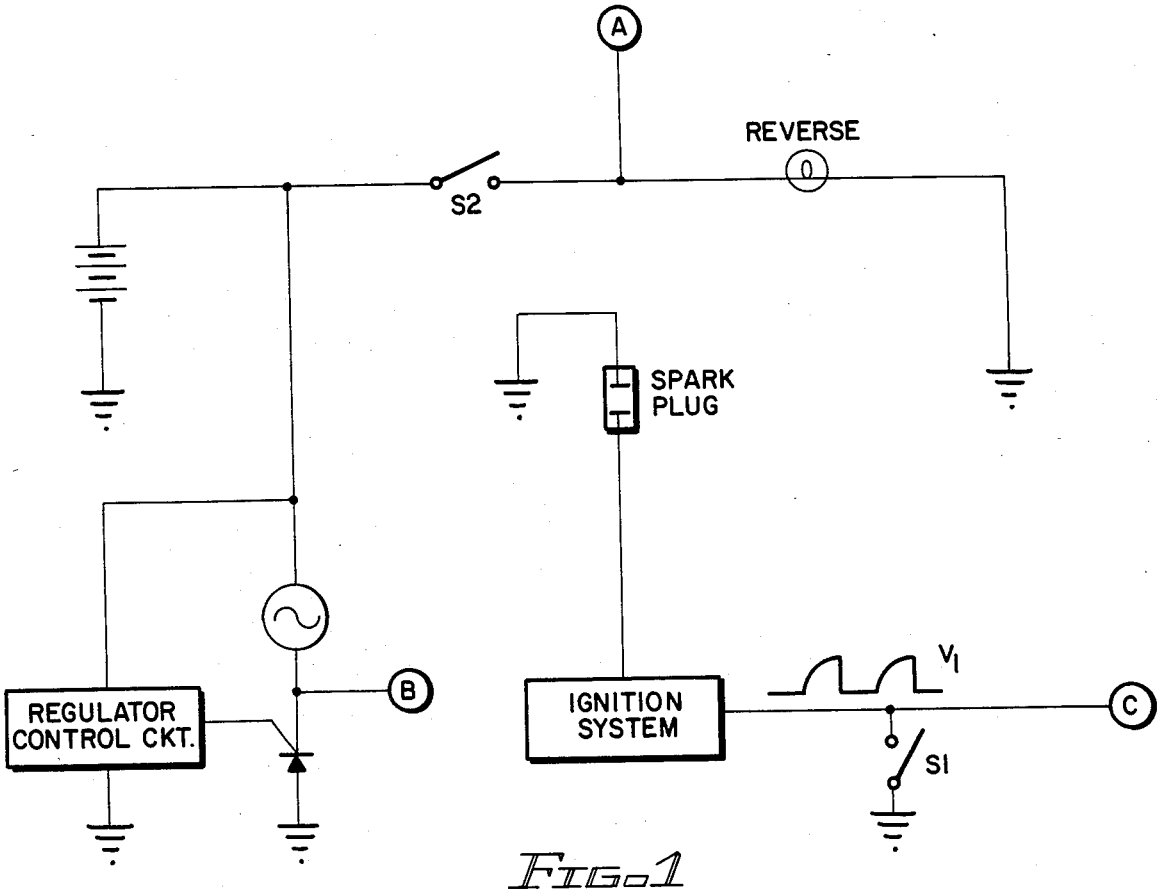
FIG. 1 is a diagram of a portion of a currently known vehicle wiring system.

FIG. 1 is a portion of a wiring diagram for a three or four wheeled recreational vehicle of the type presently being produced in the industry. Points labled A, B, and C have been added to show the connection to similarly labeled points on FIG. 2. Only the portions of the electrical wiring already on the vehicle that connect to and interact with circuit of the present invention are shown. The alternator in FIG. 1 is typically a permanent magnet alternator driven by the crank shaft of the engine not shown. It supplies power for charging the battery which in turn supplies power for the electrical systems such as lighting and starting on the vehicle. The charging of the battery by the alternator is controlled by the SCR and regulator control circuit shown in FIG. 1. It is desireable to place the SCR with its anode grounded because of the advantagious heat sinking of the SCR. This results in neither alternator lead grounded making sensing of alternator voltage for speed measuring purposes more difficult. This type of battery charging regulator is shown in applicant's pending application Ser. No. 357,892 filed 3-15-82, now U.S. Pat. No. 4,490,779. However, one skilled in the art could also adapt this RPM limiter to other types of regulators which might be used in these vehicles. Since one side of the alternator is permanently connected to the battery, the voltage at point B will be the alternator voltage superimposed upon the battery voltage. If the alternator is of the permanent magnet type both the frequency and the open circuit voltage of the alternator will change linearly with engine speed. The negative portion of the alternator wave form from point B to ground will be selectively clipped by the SCR of FIG. 1 in response to the amount of charge needed by the battery however, the positive portion of that wave form will remain essentially its open circuit value. The ignition system shown typically derives its power from a seperate winding on the alternator, however, could derive its power from another source such as the battery. Switch S1 is the existing switch which is used to short circuit an ignition system lead to ground to stop the engine. The wave form shown in C1 indicates that the ignition stop wire has a pulsating DC voltage present going positive with respect to ground. An ignition system with an AC voltage at this point could also be used as noted hereafter. An ignition system of this type is shown in applicants U.S. Pat. No. 3,566,188. Wherein the cathode of diode 16 would be point C. Switch S2 which would normally be mounted on the transmission so as to be activated when the transmission is put in the reverse position, operates a reverse indicator or back-up illumination lamp as shown. Thus the voltage at point A with respect to ground is battery voltage when the vehicle is in reverse and zero when the vehicle is in forward. Note that when the vehicle is in forward the impedance from point A to ground is relatively low being the cold resistance of the reverse indicator lamp. Further note that if the reverse indicator lamp is burnt out or removed, and the transmission is in forward, that the impedance from Point A to ground will be essentially open circuit.

Figure 2:
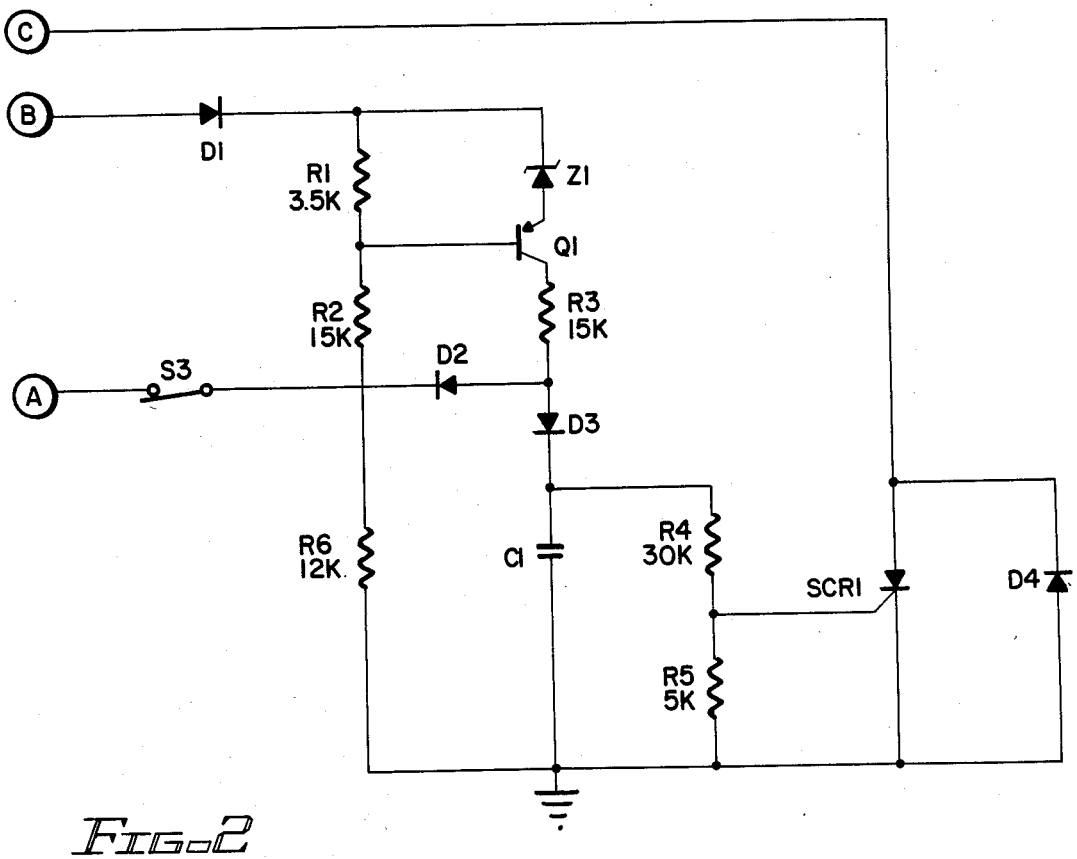
FIG. 2 is a circuit diagram of a preferred embodiment of this invention showing connection points to the circuit of FIG. 1.

Figure 2 shows a circuit diagram of an electronic speed limiter constructed in accordance with this invention. Points labeled A, B, and C, are to be connected to the similarly labeled points of the existing vehicle wiring as shown in FIG. 1. Switch 3 is an additional switch under the control of the operator the function of which will presently be described. All other FIG. 2 components will normally be encased in a potted and sealed assembly. Component values are given below. These values would be typical for an alternator producing 60 volts 0 to peak at a normal speed in reverse and producing up to twice that voltage under normal full throttle conditions. For these values assume battery charging to be at 14 volts. These values are shown only to aid in the understanding of the invention and are no way to be considered as limitations since various adaptations can be made by those skilled in the art utilizing the teachings of this invention. R1 3.5K, R2 15K, R3 15K, R4 30K, R5 5K, R6 12K, Z1 11.5 volt. when the vehicle is in reverse and thus S2 is closed and S3 is left by the operator in its normally closed position as shown, it can be seen that terminals A and B are connected directly across the alternator. Furthermore that at any instant when point B is positive with respect to A, as previously described, the alternator voltage is essentially open circuit and therefore proportional to the speed of the engine. Diode D1 prevents application of reverse voltage, which can be destructive, to the base emitter junction of transistor Q1. D1 also reduces the power dissipation in the voltage divider R1 and R2 by 50% by clipping the unneeded polarity to wave form, which, when the battery is fully charged, is essentially the same as the polarity used. The divider R1 and R2 is selected to produce a peak voltage equal to the avalanche voltage of zener diodes Z1 plus the base emitter saturation voltage of transistor Q1, at the peak voltage between points A and B corresponding to desired lower limit speed for the engine. The value of the zener diode can be chosen as is known in the art to compensate for the temperature coefficent of the base emitter voltage of the transistor Q1. This makes the circuit calibration value highly insensitive to temperature variations. The value of R1 can be adjusted to compensate for variations or tolerances in the zener Z1 and this can be done by test equipment associated with seqencers and automatic component insertion machines as described in the voltage regulator patent previously mentioned. Since only the base drive current for transistor Q1 passes through the resistive divider of R1 and R2, it can be seen by those skilled in the art that transistor Q1 goes from a off or nonconducting state to a saturated on state at the peak to the wave form, as the speed of the engine, and thus the peak value of the wave form, rises only slightly above the calibrated or desired level. The current through transistor Q1 is limited to safe levels by resistor R3 and it can be seen that the value of R3 is not critical to the calibration of the circuit which is controlled almost exclusively by the voltage of zener diode Z1 and the values of resistor R1 and R2. Since the cathode of diode D2 is at battery voltage (approximately +14 volts DC for a nominal 12 volt battery) current flowing through R3 will flow through diode D3 provided the voltage on capacitor C1 is below the battery voltage. The foregoing neglects the forward voltage drop in D2. With S3 closed as in this discussion so far, R6 represents a slight but insignificant load on the battery, and otherwise has no affect on the operation of the circuit of FIG. 2. SCR1 is capable of selectively turning off the ignition system by grounding positive voltages from point C in response to the required application of a positive voltage to its gate terminal. Other semiconductor devices could be substituted (such as a triac which might be desireable in the case of a negative going wave form at point C) by those skilled in the art and within the scope of the teaching of this invention. When used with an ignition system with no negative waveform on the stop lead, a diode such as shown by diode D4 protects the SCR1 from negative transient voltages which might arise from undesired coupling to spark plug leads. Typically SCR1 is a low current device rated at 1 amp or less for ignition systems in common use on vehicles of these types. SCR's of the type are readily and economically available and typically have a gate voltage to fire of between 0.2 and 1.1 volts and in a gate current to fire from a few microamps to approximately 100 microamps. The foregoing example values include variations with temperature and are given only to aid in understanding circuit operation and not as limitations in application of the teaching of this invention. Such an SCR can be considered to safely remain in the off state with gate voltages of at least 1/10 of a volt provided a DC path such as provided by R5 is available from the gate to the cathode. Capacitor C1 is necessary since the phase of the alternator is not always known compared to the ignition system wave form and since the transistor Q1 as is previously described conducts only during in a small portion of the alternator wave form. Capacitor C1 is chosen so that the time constant of capacitor C1 and resistor R4 is long compared to the period of the alternator. By the foregoing it can be seen that SCR1 will always be in the off state if the voltage across capacitor C1 is below 0.7 volt and will always be capable of conducting (in the presence of the positive voltage on its anode) if the voltage across capacitor C1 is higher than 10 volts. Since 10 volts is still below the voltage of the battery in this example, the collector current of transistor Q1 all flows through diode D3 and essentially none through diode D2. Thus the ignition is removed from the engine if the engine speed rises above the level where the alternator positive peak voltage at point B with respect to point A rises to turn on transistor Q1 and thus SCR1 as previously described. Thus the engine without ignition must slow down to below the speed whereupon the ignition is automatically restored preventing further decrease or stalling of the engine. If however, switch 2 is open such as when the vehicle is put in forward, point A is effectively grounded as previously described throught the reverse indicator lamp and thus the collector current of transistor Q1 is shunted through diode D2 to ground limiting the voltage on capacitor C1 to the forward voltage drop to diode D2 minus the forward voltage drop of the diode D3 at the currents then existing in the diodes in the circuit. Those skilled in the design of circuits of this type can readily see that this produces an extremely small voltage at the gate of SCR1 thus allowing the use of readily available noncritical components over an extremely large temperature range. Under this operating condition, even though the voltage of the alternator may rise to several times the voltage in the low limiting speed mode just described, the impedances of resistors R2 and R3 are sufficiently high to prevent excessive wattage dissipation in these components and in fact resistors commonly described as ¼ watt case size are suitable in the example given herein. It can be calculated that the dissipations in the diodes, zener, and transistor in the circuit are even lower. Diodes D1 through D3 and transistor Q1 must be capable of blocking the peak voltage of the alternator at its maximum speed, however, if this condition is met, even reversing the connections of leads A and B will not cause damage to the circuitry of FIG. 2. SCR1 and Diode D4 must be capable of blocking the maximum peak voltage available on the ignition system kill lead point C. Consideration will now be given to the operation of the circuit under the condition that lead A is open, either because the normally closed switch S3 is opened by the operator as previously described when higher power is needed in reverse, or when the lead is open both in reverse and forward such as by removing the reverse indicator bulb which can easily be done when a novice rider is operating the vehicle. The collector current of Q1 can thus not now be diverted through diode D2 and lead A to ground thus as previously described when Q1 conducts a voltage will be present at the gate of SCR1 and thus ignition will be removed from the engine above that speed. However, the speed will now be different from that previously obtained when point A was connected to the battery because with point A open effectively R6 is in series with resistor R2 thus changing the divider ratio previously established by R1 and R2. Thus a second limiting speed is established which with the values shown with FIG. 2 would be at an immediate value between the first limiting speed and the maximum speed capability of the engine. Consideration must be given to the effect of the battery effectively in series with R6 when the new divider ratio is calculated, since the divider is now connected not directly across the alternator but across the alternator in series to the battery. Thus is created a highly stable and accurate speed limiting device with only three connection leads to the existing vehicle wiring system and only one additional single pole single throw switch. Operation can be at full engine RPM operation unlimited by the circuit or two preselected maximum speed limits. The selection of these three possible control states is by the logical application of DC voltage and impedance level between the circuit and a single point (Point A). Further, the caibration of the circuit is controlled by the value of resistors and a zener diode and can be accomplished on commercially available automatic assembly equipment. It should be noted that this control lead is neirhter the primary input voltage or frequency lead, point B, or the prmary ignition turn off lead, point C, both which are at relatively high and therefore possibly dangerous levels of voltage.

While the invention has been described in what is prsently considered to be a preferred embodiment, many modifications will become apparent to those skilled in the art. It is intended therefore, by the appended claims to cover all such modifications as fall within the true spirit and scope of the invention.

I claim:

1. A system for selectively inhibiting ignition above a preselected engine speed for an internal combustion engine having a permanent magnet alternator, said system comprising:

(a) means for providing an electrical input which varies in a predetermined manner with the speed of the output of said permanent magnet alternator;

(b) control means adapted to control the ignition of said engine, said control means including means for inhibiting ignition responsive to a control signal;

(c) means for providing said control signal responsive to said electrical input means and to at least one of a direct current voltage, ground and open circuit inputs to thereby selectively inhibit ignition responsive to the speed of said engine; and wherein (d) said electrical input means is responsive to the peak voltage of said alternator.

2. A system for selectively inhibiting ignition above a preselected engine speed for an internal combustion engine, said system comprising:

(a) means for providing an electrical input which varies in a predetermined manner with engine speed;

(b) control means adapted to control the ignition of said engine, said control means including means for inhibiting ignition responsive to a control signal; and (c) means for providing said control signal responsive to a direct current voltage input to thereby selectively inhibit ignition responsive to the speed of said engine.

3. A system for selectively inhibiting ignition for preselected engine speeds in an internal combustion engine, said system comprising:

(a) means for providing an electrical input which varies in a predetermined manner with engine speed;

(b) control means adapted to control the ignition of said engine, said control means including means for inhibiting ignition responsive to a first control signal or a second control signal;

(c) means for providing said first control signal responsive to said electrical input means at a first predetermined engine speed and to a direct current voltage input to thereby selectively inhibit ignition responsive to said first predetermined speed of said engine; and (d) means for providing said second control signal reponsive to at a second predetermined engine speed from said electrical input means and to an open circuit input to thereby selectively inhibit the ignition responsive to said second predetermined speed of said engine.

4. A system for selectively limiting the speed of an internal combustion engine by inhibiting the ignition voltage of said engine above a preselected engine speed, said system including an alternator attached to said engine and a rectifying device connected in series with said alternator for supplying half wave rectified energy for vehicle electrical circuits, a voltage sensitive network connected across said alternator and responsive to that portion of the AC waveform of said alternator that is not conducted by said rectifying device, said network responsive above said preselected engine speed to a characteristic associated with the speed of said alternator to conduct and thus produce a control signal, an amplifying device connected to receive said control signal, the output of said amplifying device connected to remove an essential voltage from the ignition system of said engine until the engine speed decreases below said preselected level.

5. The system recited in claim 1 further comprising means for inhibiting ignition at two or more different predetermined speeds for different ones of said direct current voltage, ground and open circuit inputs.

6. The system recited in claim 3 further comprising means for applying a ground input to said system, and for preventing the inhibiting of ignition responsive to said ground input.

7. The sysytem of claim 4 wherein said network includes a resistive divider the output of which is electronically compared with a voltage reference element to produce said output when the voltage of said divider exceeds a reference voltage.

8. The system of claim 7 wherein said reference voltage is provided by a Zener diode.

9. The system of claim 8 wherein said electronic comparison is accomplished by a second amplifying device having a control terminal, a first output terminal, and a second output terminal, said voltage reference device being connected in series with said second output terminal, and an input terminal to said system.

10. The system of claim 9 wherein said voltage divider output is connected to the control terminal of said amplifying device.

11. The system of claim 4 wherein said rectifying device has its anode terminal connected to ground and its cathode terminal connected to one lead of said alternator, the other lead of said alternator being connected to a vehicle load including a battery.

12. The system recited in claim 4 wherein said characteristic is the peak voltage of said alternator.

* * * * *